US007218169B2

(12) United States Patent
Bhattacharya et al.

(10) Patent No.: US 7,218,169 B2
(45) Date of Patent: May 15, 2007

(54) REFERENCE COMPENSATION CIRCUIT

(75) Inventors: Dipankar Bhattacharya, Macungie, PA (US); Makeshwar Kothandaraman, Karnataka (IN); John Christopher Kriz, Palmerton, PA (US); Bernard Lee Morris, Emmaus, PA (US); Jeffrey Jay Nagy, Allentown, PA (US); Stefan Allen Siegel, Fogelsville, PA (US)

(73) Assignee: Agere Syatems Inc., Allentown, PA (US)

( * ) Notice: Subject to any disclaimer, the term of this patent is extended or adjusted under 35 U.S.C. 154(b) by 483 days.

(21) Appl. No.: 10/744,801

(22) Filed: Dec. 23, 2003

(65) Prior Publication Data

US 2005/0134364 A1 Jun. 23, 2005

(51) Int. Cl.
*G05F 1/10* (2006.01)
*G05F 3/02* (2006.01)

(52) U.S. Cl. ..... 327/543; 327/512

(58) Field of Classification Search ..... 327/512–513, 327/112, 543, 540–541; 326/82, 83, 86
See application file for complete search history.

(56) References Cited

U.S. PATENT DOCUMENTS 5,869,983 A 2/1999 Ilkbahar et al. ..... 326/83
5,898,321 A 4/1999 Ilkbahar et al. ..... 326/87
6,040,737 A 3/2000 Ranjan et al. ..... 327/543
6,087,853 A * 7/2000 Huber et al. ..... 326/83
6,349,060 B1 * 2/2002 Ogura ..... 365/185.21
6,429,710 B1 8/2002 Ting et al. ..... 327/206

FOREIGN PATENT DOCUMENTS

JP 2000323978 A * 11/2000

* cited by examiner

*Primary Examiner*—Quan Tra

(57) ABSTRACT

A compensation circuit comprises a reference circuit including a reference NMOS device and a reference PMOS device. The reference circuit is operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device. The compensation circuit further comprises a control circuit connected to the reference circuit. The control circuit is operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively.

25 Claims, 3 Drawing Sheets

REFERENCE COMPENSATION CIRCUIT

FIELD OF THE INVENTION

The present invention relates generally to integrated circuit (IC) devices, and more particularly to improved techniques for compensating a circuit for variations in at least semiconductor process, voltage and/or temperature.

BACKGROUND OF THE INVENTION

Circuit designers often find it necessary to utilize high speed buffer circuits (e.g., input/output (IO) buffers) to meet increasing demands for speed and performance in IC devices. However, it has become more difficult to design faster buffer circuits due, at least in part, to significant variations in buffer circuit performance over different process, voltage and temperature (PVT) ranges. Such PVT variations can affect the stability of, for example, a slew rate and/or an output impedance in a pre-driver and output section, respectively, of the buffer circuit. The slew rate of a buffer circuit is generally defined as a maximum rate of change of output voltage level for a step change at the input (e.g., rate of change from a logical 0 state to a logical 1 state, or vice versa, at the output of a circuit). To ensure signal integrity and slew rate stability, the buffer circuit is typically designed to operate well below some predefined minimum acceptable slew rate.

Under normal operating conditions, a buffer circuit may be subjected to variations in supply voltage and/or temperature, among other factors. In many applications, the buffer circuits are expected to operate over a relatively wide temperature range, such as, for example, −55 degrees Celsius (° C.) to 125° C. Generally, slew rate falls significantly as temperature rises. Power supply variations in a range of about ±10 percent may also be expected and can contribute to instability in the buffer circuit. Process variations resulting from IC fabrication can affect various characteristics of the buffer circuit including, but not limited to, threshold voltage, channel length and width, electron mobility, etc. Such characteristics may even vary among two different transistors manufactured on the same semiconductor wafer.

Previous solutions to compensate for PVT variations in a buffer circuit are described in, for example, U.S. Pat. No. 5,869,983 to Ilkbahar et al. entitled "Method and Apparatus for Controlling Compensated Buffers," U.S. Pat. No. 5,898,321 to Ilkbahar et al. entitled "Method and Apparatus for Slew Rate and Impedance Compensating Buffer Circuits," U.S. Pat. No. 6,040,737 to Ranjan et al. entitled "Output Buffer Circuit and Method that Compensate for Operating Conditions and Manufacturing Processes," and U.S. Pat. No. 6,429,710 to Ting et al. entitled "Input Buffer with Compensation for Process Variation." These known approaches, however, have several disadvantages associated therewith, including, but not limited to, inherent inaccuracies in the compensation technique and considerable complexity and/or cost.

There exists a need, therefore, for more accurate and cost effective buffer circuit compensation techniques that do not suffer from one or more of the problems exhibited by conventional methodologies.

SUMMARY OF THE INVENTION

The present invention meets the above-noted need by providing, in an illustrative embodiment, techniques for more accurately compensating for at least one of process, voltage and temperature variations in a circuit by generating one or more compensation signals based on characteristic information from both PMOS and NMOS devices. The PMOS and NMOS devices used to generate the compensation signal are preferably substantially matched to one or more PMOS and NMOS devices in the circuit to be compensated such that the compensation signal more accurately tracks PVT variations in the circuit.

In accordance with one aspect of the invention, a compensation circuit comprises a reference circuit including a reference NMOS device and a reference PMOS device. The reference circuit is operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device. The compensation circuit further comprises a control circuit connected to the reference circuit. The control circuit is operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively.

In accordance with another aspect of the invention, the reference circuit is configurable for receiving a control signal, the reference circuit being operative in at least one of a first mode and a second mode in response to the control signal. In the first mode of operation, the reference circuit generates the first reference signal, and in the second mode of operation, the reference circuit generates the second reference signal.

These and other features and advantages of the present invention will become apparent from the following detailed description of illustrative embodiments thereof, which is to be read in connection with the accompanying drawings.

DETAILED DESCRIPTION OF THE INVENTION

The present invention will be described herein in the context of an illustrative buffer circuit including a reference circuit configured for compensating for PVT variations in the buffer circuit. It should be understood, however, that the present invention is not limited to this or any particular buffer circuit. Rather, the invention is more generally applicable to any circuit arrangement in which it is desirable to provide improved compensation techniques for accurately compensating for at least process, voltage and/or temperature variations in the circuit. Moreover, although implementations of the present invention are described herein with specific reference to a complementary metal-oxide-semiconductor (CMOS) fabrication process and to NMOS and PMOS transistor devices, it is to be appreciated that the invention is not limited to such a fabrication process and/or such transistor devices, and that other suitable process technologies, such as, but not limited to, bipolar, bipolar CMOS (BiCMOS), etc., and/or transistor devices, such as, but not limited to, bipolar junction transistors (BJTs), etc., may be similarly employed, as will be understood by those skilled in the art.

One method for compensating for PVT variations in a buffer circuit is to generate a reference voltage based on an n-type metal-oxide-semiconductor (NMOS) device. The reference voltage is compared against a predetermined set of voltage levels in a control block and digital bits are generated which represent the state of the NMOS device under that particular PVT point. These digital bits are then used to compensate for PVT variations in both p-type metal-oxide-semiconductor (PMOS) devices and NMOS devices in the buffer circuit. Thus, compensation information derived from an NMOS device is used to compensate for characteristic variations in a PMOS device. Unfortunately, using modern deep sub-micron semiconductor technology, the properties of PMOS and NMOS devices can vary significantly. Compensating PMOS devices based only on NMOS device characteristics is thus inherently inaccurate. For many standard applications, this compensation methodology may be sufficient. However, as buffer circuit tolerances become more and more stringent, it becomes increasingly more difficult to meet buffer specifications under all PVT corner points using this compensation scheme.

Figure 1:
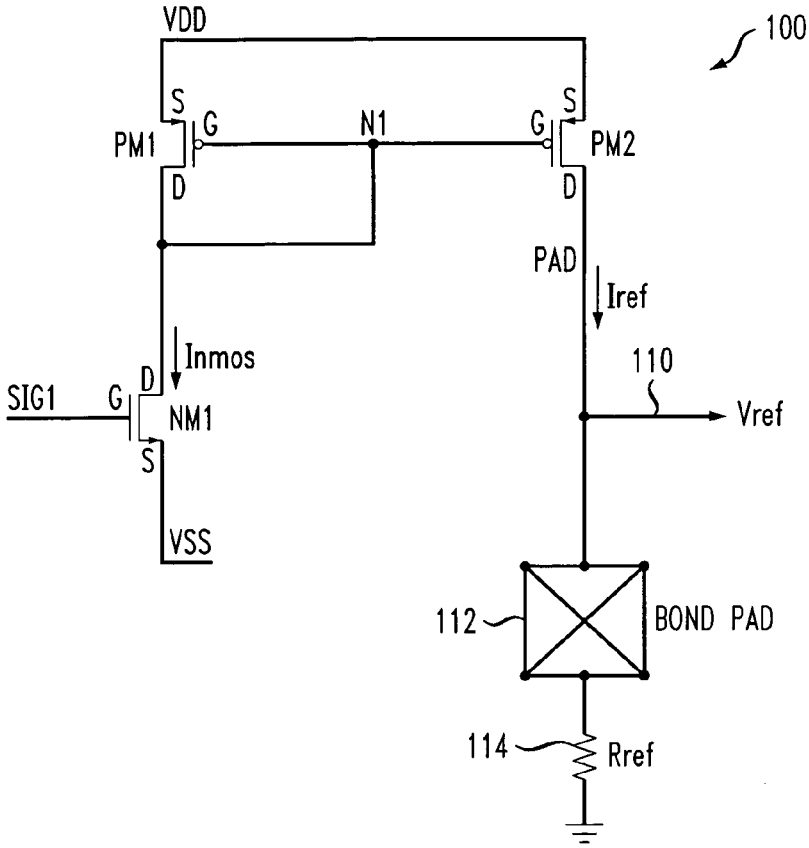
FIG. 1 is a schematic diagram depicting an illustrative reference circuit which may be modified to implement the techniques of the present invention.

FIG. 1 is a schematic diagram depicting an illustrative semiconductor reference circuit 100 that can be modified to implement the methodologies of the present invention. The illustrative reference circuit 100 comprises an NMOS transistor NM1 having drain (D), gate (G) and source (S) terminals. The source terminal of transistor NM1 is connected to a negative voltage supply, which may be VSS, and the gate terminal of NM1 is preferably connected to a control signal SIG1 which is used to control a current Inmos in the transistor NM1.

The drain terminal of transistor NM1 is preferably connected to a current mirror formed of PMOS transistors PM1 and PM2, each having drain (D), gate (G) and source (S) terminals. Transistor PM1 is connected in a diode arrangement, with its gate and drain terminals coupled together and its source terminal connected to a positive voltage supply, which may be VDD. The gate terminals of transistors PM1 and PM2 are connected together at node N1 and the source terminals of transistors PM1 and PM2 are connected together at the positive voltage supply. The drain terminal of transistor PM2 is connected to an output node 110 of the reference circuit 100. The output node 110 is preferably coupled to a bond pad 112 of the IC, to which a load resistor 114 is preferably connected.

The current mirror comprised of transistors PM1 and PM2 preferably generates a current Iref in transistor PM2 that is substantially matched to the current Inmos in transistor PM1. A voltage Vref will be generated at output node 110 that is a function of the current Iref and a resistance value Rref of resistor 114 such that Vref=Iref×Rref. Assuming an ideal current mirror, the voltage Vref generated at the output 110 of the reference circuit 100 will vary primarily as a function of the PVT variations of NMOS transistor NM1.

Figure 2:
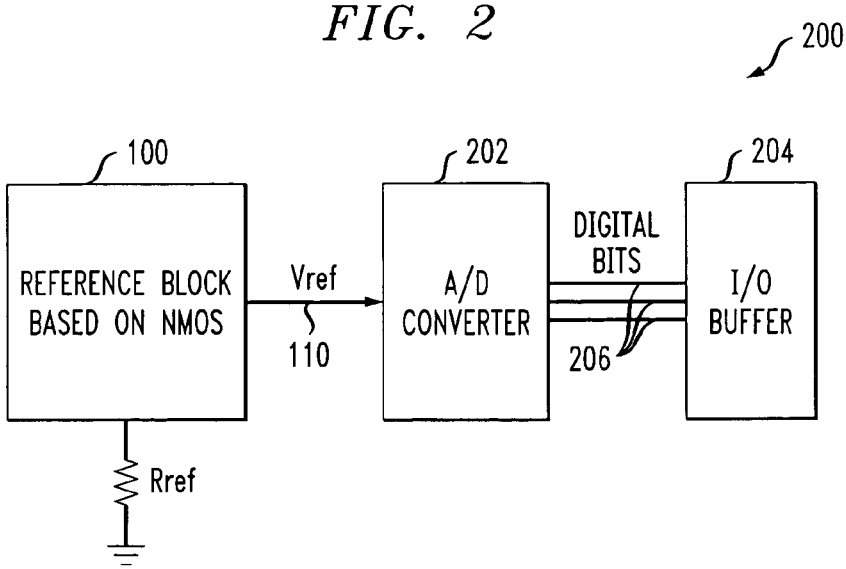
FIG. 2 is a block diagram illustrating an illustrative compensated buffer circuit which may be modified to implement the techniques of the present invention.

FIG. 2 depicts an illustrative compensated buffer circuit 200 which can be modified to implement the techniques of the present invention. The illustrative buffer circuit 200 includes the reference circuit 100 described above in conjunction with FIG. 1, an analog-to-digital (A/D) converter 202 coupled to the reference circuit 100, and an IO buffer 204 coupled to the A/D converter. The A/D converter 202 is configured to receive as an input the analog reference voltage Vref generated at the output 110 of the reference circuit 100 and convert the analog input voltage into a digital output signal. The output signal generated by the A/D converter 202 comprises a plurality of digital bits 206 representing the analog input voltage Vref.

The reference voltage Vref generated at the output 110 of the reference circuit 100 is compared against a pre-defined set of voltage levels in the A/D converter 202 and digital bits 206 are generated to represent a state of the NMOS device NM1 under that particular PVT condition. These digital bits 206 are subsequently used to compensate for the characteristic variations in both PMOS and NMOS transistor devices in a pre-driver and output section (not shown) of the IO buffer circuit 204 to control, for example, slew rate and/or output impedance of the IO buffer 220. Thus, compensation information based on the NMOS device is also used for the PMOS devices.

Since the output voltage Vref generated at the output 110 of the reference circuit 100 is based primarily on characteristics of NMOS transistor NM1, the digital bits 206 generated by the A/D converter 202 will also vary as a function of PVT variations of the NMOS transistor NM1. Accordingly, NMOS transistor devices present in the IO buffer 204 maybe operatively compensated for such PVT variations. However, PMOS transistor devices present in the buffer 204, which generally do not track PVT variations in an NMOS device, cannot be accurately compensated based on NMOS characteristic information alone.

Figure 3:
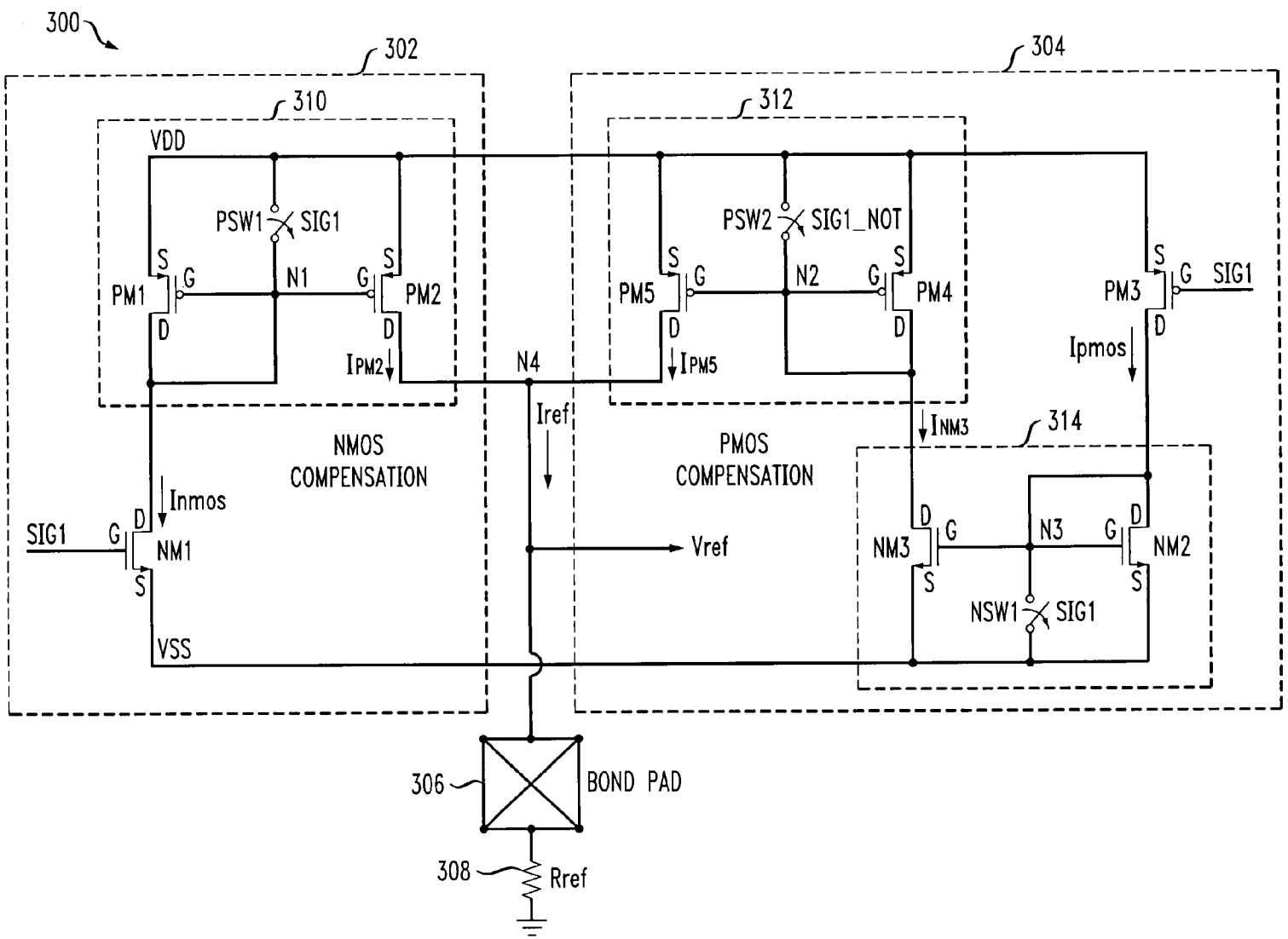
FIG. 3 is a schematic diagram depicting an exemplary reference compensation circuit, formed in accordance with one embodiment of the present invention.

FIG. 3 illustrates an exemplary reference circuit 300, formed in accordance with one embodiment of the present invention. The exemplary reference circuit 300 comprises an NMOS compensation portion 302 and a PMOS compensation portion 304. The NMOS and PMOS compensation portions 302, 304 are preferably coupled together at an output node N4 of the reference circuit 300. Node N4 maybe connected to a bond pad 306 so that an external resistor 308, having a value Rref, can be connected to node N4 for setting the output voltage Vref of the reference circuit 300 as desired.

The NMOS compensation portion 302 may be formed in a manner similar to the reference circuit 100 shown in FIG. 1. Specifically, NMOS compensation portion 302 preferably comprises an NMOS transistor NM1 having drain (D), gate (G) and source (S) terminals. The source terminal of NM1 is connected to the negative voltage supply, which is preferably VSS, and the gate terminal of NM1 is coupled to a control signal SIG1 for controlling a current Inmos flowing in NM1. The drain terminal of NM1 is preferably coupled to a current mirror 310.

Current mirror 310 may comprise a first PMOS transistor PM1 and a second PMOS transistor PM2, each having drain (D), gate (G) and source (S) terminals. Transistor PM1 is preferably connected in a diode configuration with its gate and drain terminals connected together and the source terminal of PM1 connected to the positive voltage supply, preferably VDD. The drain terminals of PM1 and NM1 are connected together, and thus the current Inmos flowing in NM1 also flows in PM1. The gate terminal of transistor PM2 is connected to the gate terminal of PM1 at node N1 and the source terminal of PM2 is connected to the positive voltage supply VDD. Since the gate-to-source voltage of transistor PM1 will be the same as the gate-to-source voltage for transistor PM2, the drain current Inmos in PM1 will be substantially matched to the drain current $I_{PM2}$ in PM2. The current Inmos may be referred to as a reference current of current mirror 310 and the current $I_{PM2}$ may be referred to as an output current of the current mirror 310.

The NMOS compensation portion 302 of reference circuit 300 preferably includes a mechanism for selectively enabling the current mirror 310. This mechanism may comprise, for example, a switch PSW1 connected between the positive voltage supply VDD and node N1. When the switch PSW1 is in a first (closed) state, the voltage across the source and gate terminals of transistors PM1 and PM2 will be zero, and thus the current mirror 310 will be disabled. Likewise, when the switch PSW1 is in a second (open) state, the current mirror 310 will be enabled. The switch PSW1 is preferably controlled by a control signal, which may be SIG1. Switch PSW1 is preferably configured such that when SIG1 is at a logic high level, the switch will be open and when SIG1 is at a logic low level, the switch will be closed. In a preferred embodiment of the invention, switch PSW1 may comprise a PMOS transistor having a source terminal connected to the positive voltage supply VDD, a drain terminal connected to node N1 and a gate terminal connected to control signal SIG1. Alternative switch arrangements are similarly contemplated by the present invention, as will be apparent to those skilled in the art.

Current mirror 310 preferably generates a current $I_{PM2}$ in transistor PM2 that is substantially matched to the current Inmos in transistor NM1, although the two currents $I_{PM2}$ and Inmos may be scaled relative to one another, as will be understood by those skilled in the art. In either instance, assuming that current mirror 310 is substantially ideal, in a first state (e.g., when control signal SIG1 is at a logic high level), the voltage Vref generated at the output node N4 of the reference circuit 300 will vary primarily as a function of the PVT variations of NMOS transistor NM1. Therefore, this output voltage can be used to accurately compensate for PVT variations in one or more NMOS devices which may reside external to the reference circuit 300.

The PMOS compensation portion 304 of exemplary reference circuit 300 preferably comprises a PMOS transistor PM3 having drain (D), gate (G) and source (S) terminals. The source terminal is preferably connected to the positive voltage supply VDD and the gate terminal is connected to a control signal SIG1, which may be the same signal presented to the gate terminal of transistor NM1. As in the case of transistor NM1, control signal SIG1 applied to the gate terminal of PM3 is preferably used to control a current Ipmos in transistor PM3. The drain terminal of transistor PM3 is connected to a first current mirror 314.

First current mirror 314 may be implemented as a simple mirror comprising NMOS transistors NM2 and NM3, each having drain (D), gate (G) and source (S) terminals. Transistor NM2 is connected in a diode configuration, with its gate and drain terminals connected together at node N3 and its source terminal connected to the negative voltage supply VSS. The drain terminals of NM2 and PM3 are connected together, and thus the current Ipmos flowing in PM3 also flows in NM2. The gate terminal of transistor NM3 is connected to the gate terminal of NM2 at node N3 and the source terminal of NM3 is connected to the negative voltage supply VSS. Since the gate-to-source voltage of transistor NM2 will be the same as the gate-to-source voltage for transistor NM3, the drain current Ipmos in NM2 will be substantially matched to a drain current INM3 in NM3. The current Ipmos may be referred to as the reference current of current mirror 314 and the current $I_{NM3}$ may be referred to as the output current of the current mirror 314. The drain terminal of transistor NM3 is preferably connected to a second current mirror 312.

PMOS compensation portion 304 of reference circuit 300 preferably includes a mechanism for selectively enabling the current mirror 314. This mechanism may comprise, for example, a switch NSW1 connected between node N3 and the negative voltage supply VSS. When the switch NSW1 is in a first (closed) state, the voltage across the source and gate terminals of transistors NM2 and NM3 will be zero, thereby disabling the current mirror 314. Likewise, when the switch NSW1 is in a second (open) state, the current mirror 314 will be enabled. The switch NSW1 is preferably controlled by a control signal, which may be SIG1. Switch NSW1 is preferably configured such that when SIG1 is at a logic high level, the switch will be closed and when SIG1 is at a logic low level, the switch will be open. In a preferred embodiment of the invention, switch NSW1 may comprise an NMOS transistor having a source terminal connected to the negative voltage supply VSS, a drain terminal connected to node N3 and a gate terminal connected to control signal SIG1.

Current mirror 312, like current mirror 310, preferably comprises a pair of PMOS transistors PM4 and PM5, each having drain (D), gate (G) and source (S) terminals. Transistor PM4 is preferably connected in a diode configuration, with its gate and drain terminals connected together at node N2 and its source terminal connected to the positive voltage supply VDD. The drain terminals of transistors PM4 and NM3 may be connected together, and therefore the current $I_{NM3}$ flowing in NM3 will also flow in PM4. The gate terminal of transistor PM5 is connected to the gate terminal of PM4 at node N2 and the source terminal of PM5 is connected to the positive voltage supply VDD. Since the gate-to-source voltage of transistor PM5 will be the same as the gate-to-source voltage for transistor PM4, the drain current $I_{NM3}$ in PM4 will be substantially matched to a drain current $I_{PM5}$ in PM5. The current $I_{NM3}$ may be referred to as the reference current of current mirror 312 and the current $I_{PM5}$ may be referred to as the output current of the current mirror 312.

A switch PSW2 is preferably connected between the positive voltage supply VDD and node N2 for selectively enabling current mirror 312. When the switch PSW2 is in a first (closed) state, the voltage across the source and gate terminals of transistors PM4 and PM5 will be zero, thereby disabling current mirror 312. Likewise, when the switch PSW2 is in a second (open) state, the current mirror 312 will be enabled. Switch PSW2 is preferably controlled by a control signal, which may be an inverted version of SIG1, namely, SIG1_NOT. Switch PSW2 is preferably configured such that when SIG1_NOT is at a logic high level (i.e., when SIG1 is low), the switch will be open and when SIG1_NOT is at a logic low level (i.e., when SIG1 is high), the switch will be closed. In a preferred embodiment of the invention, switch PSW2 may comprise a PMOS transistor having a source terminal connected to the positive voltage supply VDD, a drain terminal connected to node N2 and a gate terminal connected to control signal SIG1_NOT. Alternatively, switch PSW2 may comprise a combination of PMOS and NMOS transistors, as will be understood by those skilled in the art.

Current mirror 312 preferably generates a current $I_{PM5}$ in transistor PM5 that is substantially matched to the current Ipmos in transistor PM3, although the two currents $I_{PM5}$ and Ipmos may be scaled relative to one another, as will be understood by those skilled in the art. In either case, assuming that current mirrors 312 and 314 are substantially ideal, in a second state (e.g., when control signal SIG1 is at a logic low level), the voltage Vref generated at the output node N4 of the reference circuit 300 will vary primarily as a function of the PVT variations of PMOS transistor PM3. Therefore, this output voltage can be used to accurately compensate for PVT variations in one or more PMOS devices which may reside external to the reference circuit 300.

It is to be understood that, while current mirrors 310, 312 and 314 are shown connected in a simple current mirror configuration, one or more of the current mirrors may be implemented using an alternative circuit arrangement, including, but not limited to, a cascode current mirror, Wilson current mirror, etc., as known by those skilled in the art. These alternative current mirror configurations may provide improved matching between the reference current and corresponding output current. Furthermore, in accordance with another aspect of the invention, one or more of the current mirrors 310, 312 and 314 may provide current scaling, such as, for example, by appropriately sizing corresponding transistors (e.g., PM1/PM2) in the respective current mirrors. Although the current mirrors are depicted comprising NMOS and PMOS transistor devices, one or more of the current mirrors may alternatively be implemented using NPN and PNP BJT devices, respectively.

The drain terminals of transistors PM2 and PM5 are connected together at node N4, which forms an output of the exemplary reference circuit 300, as previously explained. The reference circuit 300 is preferably configured such that an output current Iref is selectively determined either by the NMOS compensation portion 302 in a first state, and is thus substantially equal to the current $I_{PM2}$ in transistor PM2, or by the PMOS compensation portion 304 in a second state, and is thus substantially equal to the current $I_{PM5}$ in transistor PM5, depending upon the logical state of the control signal SIG1. Thus, when the reference circuit 300 is in the first state (e.g., when control signal SIG1 is at a logic high), the output voltage Vref can be used for NMOS device compensation. Likewise, when the reference circuit 300 is in the second state (e.g., when control signal SIG1 is at a logic low), the output Vref can be used for PMOS device compensation. A more detailed description of the operation of exemplary reference circuit 300 will be presented herein below, by way of example only.

During an NMOS compensation mode, signal SIG1 is brought to a logic high level (e.g., VDD), turning on NMOS transistor NM1. A quantity of current Inmos is generated based primarily on the PVT conditions of transistor NM1. The current Inmos is mirrored, and possibly scaled, by devices PM1 and PM2 in current mirror 310 to generate output current $I_{PM2}$. This output current $I_{PM2}$ is passed through external resistor 308 to generate the output voltage Vref at node N4. A reference voltage is thereby generated across the resistor 308 that is a function of the state of the NMOS device NM1 for a given PVT condition.

During the NMOS compensation mode, switch PSW1 is open. Device PM3 is gated by the same control signal SIG1. Since SIG1 is a logic high during this mode, transistor PM3 will be turned off, and therefore current Ipmos will be substantially zero. Switch NSW1, which is also controlled by signal SIG1, will be closed, thereby pulling node N3 to the negative voltage supply VSS and disabling current mirror 314 by turning off transistors NM2 and NM3. Switch PSW2, which is controlled by signal SIG1_NOT, an inverted version of SIG1, will be closed, thereby pulling node N2 to the positive voltage supply VDD and disabling current mirror 312 by turning off transistors PM4 and PM5. The external resistor 308 therefore receives only the current contribution $I_{PM2}$ from the NMOS compensation portion 302 of the reference circuit 300.

During a PMOS compensation mode, signal SIG1 is brought to a logic low level (e.g., VSS). This turns on PMOS transistor PM3 and establishes a current Ipmos based primarily on the PVT conditions of transistor PM3 at that particular instance. The current Ipmos is mirrored, and possibly scaled, by transistors NM2 and NM3 in current mirror 314 and transistors PM4 and PM5 in current mirror 312 to generate output current $I_{PM5}$. This output current $I_{PM5}$ is passed through the external resistor 308 to generate the output voltage Vref at node N4. A reference voltage is thereby generated across the resistor 308 that is a function of the state of the PMOS device PM3 for a given PVT condition.

During the PMOS compensation mode, both switches NSW1 and PSW2 are open, thus enabling current mirrors 314 and 312, respectively, in the PMOS compensation portion 304 of reference circuit 300. Since control signal SIG1 is a logic low level during this mode, NMOS transistor NM1 is turned off and thus generates substantially no current. Switch PSW1 will be closed, thereby pulling node N1 to the positive voltage supply VDD and disabling current mirror 310 by turning off transistors PM1 and PM2. The external resistor 308 therefore receives only the current contribution $I_{PM5}$ from the PMOS compensation portion 304 of the reference circuit 300.

In accordance with another aspect of the invention, additional circuitry (not shown) may be included in the exemplary reference circuit 300 for turning off all current mirrors 310, 312 and 314 during a low power (e.g., power down) mode of operation. In this manner, the overall current consumption in the reference circuit 300 will be substantially zero during low power mode.

In a preferred embodiment of the invention, the currents $I_{PM2}$ and $I_{PM5}$ are adjusted, for example by appropriately scaling the transistor devices in current mirrors 310, 312, 314, such that the output voltage Vref generated during the NMOS compensation mode is substantially the same as the output voltage generated during the PMOS compensation mode under normal operating conditions.

A clock signal, which may be supplied internally or externally to the reference circuit 300, is preferably employed to generate the control signals SIG1 and SIG1_NOT for selectively switching between modes of operation of the reference circuit. A frequency of the clock is preferably chosen such that the current mirrors 310, 312, 314 in the reference circuit 300 are allowed ample time to substantially settle to their respective steady state values. The amount of time which the reference circuit is operable in the NMOS compensation mode compared to the PMOS compensation mode need not be equal, and thus the duty cycle of the clock signal is not required to be 50 percent. In fact, since the number of circuit nodes in the PMOS compensation portion 304 of the reference circuit 300 is greater than the number of nodes in the NMOS compensation portion 302, and therefore the reference circuit may take longer to settle in the PMOS compensation mode, it may be desirable to at least slightly offset the duty cycle of the clock signal (e.g., 40–60 duty cycle) to allow more time per clock period for the PMOS compensation mode. By doing so, the maximum frequency of the clock signal may be able to be advantageously increased.

It is to be understood that, although the exemplary reference circuit 300 is depicted as being operable in a PMOS compensation mode and an NMOS compensation mode, the reference circuit, in an alternative embodiment of the invention, may include separate reference outputs corresponding to the NMOS compensation portion 302 and the PMOS compensation portion 304. In this instance, the reference circuit 300 may be configured so as to provide NMOS and PMOS compensation information substantially concurrently, thereby eliminating the need to selectively switch between two or more operating modes of the circuit.

Figure 4:
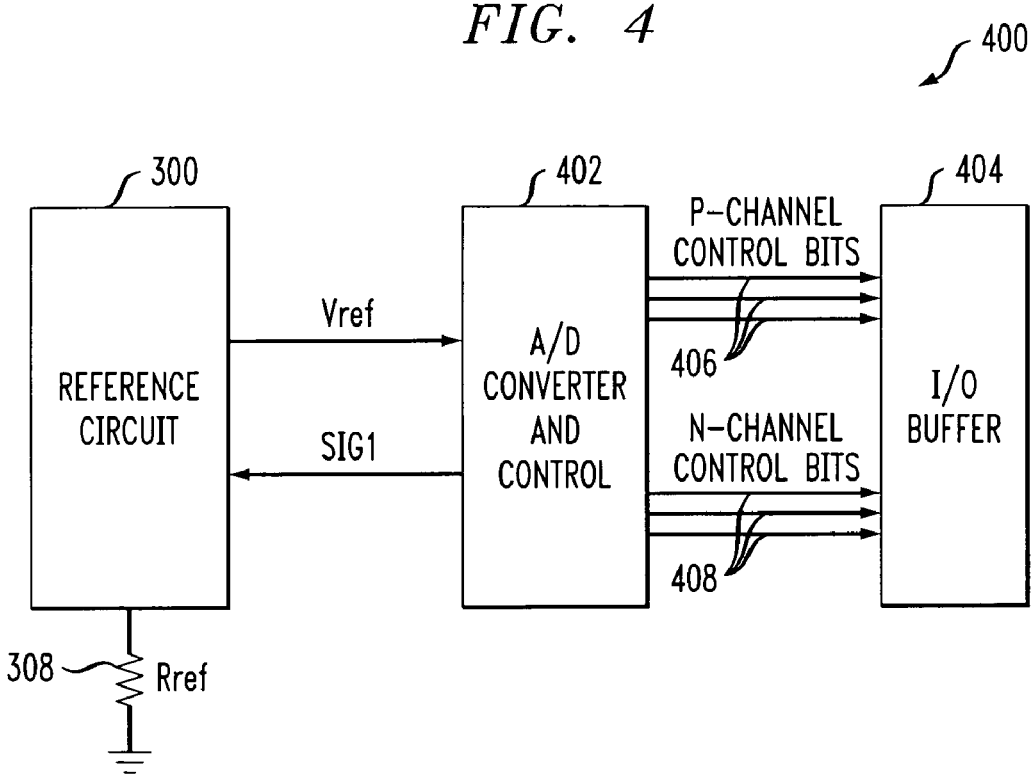
FIG. 4 is a block diagram depicting an exemplary compensated buffer circuit including the reference compensation circuit of FIG. 3, formed in accordance with another embodiment of the present invention.

FIG. 4 is a block diagram illustrating an exemplary compensated buffer circuit 400, formed in accordance with one embodiment of the invention. The exemplary compensated buffer circuit 400 comprises reference circuit 300, described above in conjunction with FIG. 3, an A/D converter and control block 402 coupled to the reference circuit 300, and an IO buffer circuit 404 coupled to the A/D converter and control block. While the compensated buffer circuit 400 is shown as including separate function blocks, it is to be appreciated that one or more of these functional blocks may be combined, or one or more of the blocks may be divided into additional blocks, with or without modifications thereto. In the compensated buffer circuit 400, the control signal SIG1 for selectively controlling the mode of operation of the reference circuit 300 is generated by the A/D converter and control block 402. It is to be appreciated, however, that this control signal may be generated by an alternative control circuit.

The reference voltage Vref generated during the NMOS and PMOS compensation phases of the control signal SIG1 are received by the A/D converter and control block 402, which preferably generates two sets of digital bits 406 and 408 corresponding to the PMOS compensation mode and NMOS compensation mode, respectively. The two sets of digital bits 406, 408 are sent to the IO buffer circuit 404 (e.g., in serial, parallel, etc.) for separately compensating for at least PVT variations in one or more PMOS and NMOS devices, respectively, in the IO buffer circuit. In a preferred embodiment of the invention, the A/D converter and control block 402 includes a latch, or alternative storage circuit (e.g., random access memory, etc.), for at least temporarily storing the two sets of digital bits 406, 408 while the PMOS and NMOS compensation information is at least periodically updated by the A/D converter and control block.

For improved PMOS and NMOS device compensation, the PMOS devices in the IO buffer circuit 404 are preferably formed on the same semiconductor die and/or in close relative proximity to at least the PMOS device PM3 in the reference circuit 300. Likewise, the NMOS devices in the IO buffer circuit 404 are preferably formed on the same semiconductor die and/or in close relative proximity to at least the NMOS device NM1 in the reference circuit 300. In this manner, PVT variations in the PMOS and NMOS devices in the IO buffer circuit 404 may be more accurately compensated.

Although illustrative embodiments of the present invention have been described herein with reference to the accompanying drawings, it is to be understood that the invention is not limited to those precise embodiments, and that various other changes and modifications may be made therein by one skilled in the art without departing from the scope of the appended claims.

What is claimed is:

1. A compensation circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device, the reference circuit being configured to provide the first and second reference signals as separate and independent outputs; and a control circuit connected to the reference circuit, the control circuit being operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively.

2. A compensation circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device; and a control circuit connected to the reference circuit, the control circuit being operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively;

wherein the reference circuit is configured for receiving a control signal, the reference circuit being operative in at least one of a first mode and a second mode in response to the control signal, wherein in the first mode the reference circuit generates the first reference signal, and in the second mode the reference circuit generates the second reference signal.

3. A compensation circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device; and a control circuit connected to the reference circuit, the control circuit being operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively;

wherein the reference circuit comprises an NMOS compensation portion and a PMOS compensation portion, the reference circuit being selectively operable in at least one of a first mode and a second mode, wherein in the first mode the NMOS compensation portion generates the first reference signal, and in the second mode the PMOS compensation portion generates the second reference signal.

4. The circuit of claim 3, wherein the reference circuit is configured such that when the reference circuit is operative in the first mode, the NMOS compensation portion is enabled and the PMOS compensation portion is disabled, and when the reference circuit is operative in the second mode, the PMOS compensation portion is enabled and the NMOS compensation portion is disabled.

5. The circuit of claim 3, wherein the reference is further operative in a third mode, the reference circuit being configured such that when the reference circuit is operative in the third mode, the NMOS compensation portion and the PMOS compensation portion are disabled.

6. A compensation circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device; and a control circuit connected to the reference circuit, the control circuit being operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively;

wherein the reference circuit comprises an NMOS compensation portion and a PMOS compensation portion, the NMOS compensation portion comprising:

the reference NMOS device including a drain terminal, a gate terminal and a source terminal; and a current mirror connected to the drain terminal of the NMOS reference device at a first terminal and being connected to an output of the reference circuit at a second terminal; and the PMOS compensation portion comprising:

the reference PMOS device including a drain terminal, a gate terminal and a source terminal;

a first current mirror connected to the drain terminal of the reference PMOS device at a first terminal; and a second current mirror connected to a second terminal of the first current mirror at a first terminal and being connected to the output of the reference circuit at a second terminal;

wherein the reference circuit is selectively operable in at least one of a first mode and a second mode, the NMOS compensation portion generating the first reference signal in the first mode, and the PMOS compensation portion generating the second reference signal in the second mode.

7. A compensation circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device; and a control circuit connected to the reference circuit, the control circuit being operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively;

wherein the reference circuit comprises an NMOS compensation portion and a PMOS compensation portion, the NMOS compensation portion including the reference NMOS device and a first current mirror connected to the reference NMOS device, the PMOS compensation portion including the reference PMOS device, a second current mirror connected to the reference PMOS device and a third current mirror connected to the second current mirror, wherein each of at least one of the first, second and third current mirrors is configurable for receiving a control signal and for selectively disabling the corresponding current mirror in response to the control signal.

8. The circuit of claim 2, wherein at least one of the first and second reference signals comprises a reference voltage, the reference voltage level being selectively adjustable as a function of at least one resistor connected to the reference circuit.

9. The circuit of claim 2, wherein the control circuit comprises an analog-to-digital converter operative to receive the first and second reference signals and to convert the first and second reference signals to first and second digital output signals, respectively, the first digital output signal comprising a digital representation of at least one of the process, voltage and temperature characteristic of the reference NMOS device, the second digital output comprising a digital representation of at least one of the process, voltage and temperature characteristic of the reference PMOS device.

10. The circuit of claim 9, wherein the analog-to-digital converter is operative: (i) to receive the first and second reference signals from the reference circuit; (ii) to compare the reference signals against a predetermined set of signal levels; (iii) to generate a first and second plurality of digital bits, the first and second plurality of digital bits representing a state of the reference NMOS device and reference PMOS device, respectively, under a particular process, voltage and temperature condition; and (iv) to transmit the digital bits to the circuit to be compensated.

11. The circuit of claim 9, wherein the plurality of digital bits is transmitted to the circuit to be compensated in a serial manner.

12. The circuit of claim 9, wherein the plurality of digital bits is transmitted to the circuit to be compensated in a parallel manner.

13. The circuit of claim 2, wherein the control signal comprises a clock signal including at least a first level and a second level, the reference circuit being operative in the first mode during the first clock level and being operative in the second mode during the second clock level.

14. The circuit of claim 13, wherein a duration of the first and second clock levels are substantially equal to one another.

15. The circuit of claim 13, wherein a duration of the first and second clock levels are not equal to one another.

16. The circuit of claim 2, wherein at least one of the reference NMOS device and the reference PMOS device in the reference circuit is formed in close relative proximity to the at least one NMOS device and at least one PMOS device, respectively, in the circuit to be compensated.

17. The circuit of claim 2, wherein at least one of the reference NMOS device and the reference PMOS device in the reference circuit is substantially matched to the at least one NMOS device and at least one PMOS device, respectively, in the circuit to be compensated.

18. A compensated buffer circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device, the reference circuit being configured to provide the first and second reference signals as separate and independent outputs;

an input/output buffer comprising an output stage including at least one NMOS device and at least one PMOS device; and a control circuit connected to the reference circuit and to the input/output buffer, the control circuit being operative to receive the first and second reference signals and to generate one or more output signals for compensating for a variation in at least one of a process characteristic, a voltage characteristic and a temperature characteristic of the at least one NMOS device and the at least one PMOS device in the input/output buffer in response to the first and second reference signals, respectively.

19. A compensated buffer circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device;

an input/output buffer comprising an output stage including at least one NMOS device and at least one PMOS device; and a control circuit connected to the reference circuit and to the input/output buffer, the control circuit being operative to receive the first and second reference signals and to generate one or more output signals for compensating for a variation in at least one of a process characteristic, a voltage characteristic and a temperature characteristic of the at least one NMOS device and the at least one PMOS device in the input/output buffer in response to the first and second reference signals, respectively;

wherein the reference circuit is configured for receiving a control signal, the reference circuit being operative in at least one of a first mode and a second mode in response to the control signal, wherein in the first mode the reference circuit generates the first reference signal, and in the second mode the reference circuit generates the second reference signal.

20. The compensated buffer circuit of claim 19, wherein the control circuit comprises an analog-to-digital converter operative to receive the first and second reference signals and to convert the first and second reference signals to first and second digital output signals, respectively, the first digital output signal comprising a digital representation of at least one of the process, voltage and temperature characteristic of the reference NMOS device, the second digital output comprising a digital representation of at least one of the process, voltage and temperature characteristic of the reference PMOS device.

21. The compensated buffer circuit of claim 20, wherein the analog-to-digital converter is operative: (i) to receive the first and second reference signals from the reference circuit; (ii) to compare the reference signals against a predetermined set of signal levels; (iii) to generate a first and second plurality of digital bits, the first and second plurality of digital bits representing a state of the reference NMOS device and reference PMOS device, respectively, under a particular process, voltage and temperature condition; and (iv) to transmit the digital bits to the input/output buffer for operatively compensating the input/output buffer.

22. A compensated buffer circuit, comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device;

an input/output buffer comprising an output stage including at least one NMOS device and at least one PMOS device; and a control circuit connected to the reference circuit and to the input/output buffer, the control circuit being operative to receive the first and second reference signals and to generate one or more output signals for compensating for a variation in at least one of a process characteristic, a voltage characteristic and a temperature characteristic of the at least one NMOS device and the at least one PMOS device in the input/output buffer in response to the first and second reference signals, respectively;

wherein the reference circuit comprises an NMOS compensation portion and a PMOS compensation portion, the reference circuit being selectively operable in at least one of a first mode and a second mode, wherein in the first mode the NMOS compensation portion generates the first reference signal, and in the second mode the PMOS compensation portion generates the second reference signal.

23. An integrated circuit device including at least one compensation circuit, the at least one compensation circuit comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device; and a control circuit connected to the reference circuit, the control circuit being operative to receive the first and second reference signals and to generate one or more output signals for compensating for a variation in at least one of a process characteristic, a voltage characteristic and a temperature characteristic of at least one NMOS device and at least one PMOS device in a circuit to be compensated, which is connectable to the control circuit, in response to the first and second reference signals, respectively;

wherein the reference circuit is configured for receiving a control signal, the reference circuit being operative in at least one of a first mode and a second mode in response to the control signal, wherein in the first mode the reference circuit generates the first reference signal, and in the second mode the reference circuit generates the second reference signal.

24. An integrated circuit device including at least one compensated buffer circuit, the at least one compensated buffer circuit comprising:

a reference circuit including a reference NMOS device and a reference PMOS device, the reference circuit being operative to generate a first reference signal and a second reference signal, the first reference signal being a function of at least one of a process characteristic, a voltage characteristic and a temperature characteristic of the reference NMOS device, and the second reference signal being a function of at least one of a process characteristic, a voltage characteristic and a temperature characteristic of the reference PMOS device;

an input/output buffer comprising an output stage including at least one NMOS device and at least one PMOS device; and a control circuit connected to the reference circuit and to the input/output buffer, the control circuit being operative to receive the first and second reference signals and to generate one or more output signals for compensating for a variation in at least one of a process characteristic, a voltage characteristic and a temperature characteristic of the at least one NMOS device and the at least one PMOS device in the input/output buffer in response to the first and second reference signals, respectively;

wherein the reference circuit is configured for receiving a control signal, the reference circuit being operative in at least one of a first mode and a second mode in response to the control signal, wherein in the first mode the reference circuit generates the first reference signal, and in the second mode the reference circuit generates the second reference signal.

25. The circuit of claim 1, wherein the separate and independent outputs are provided by one of: (i) a single output line, the first reference signal being supplied on the output line in a first mode of operation of the reference circuit and the second reference signal being supplied on the output line in a second mode of operation of the reference circuit; and (ii) separate output lines for each of the first and second reference signals.

* * * * *

UNITED STATES PATENT AND TRADEMARK OFFICE

CERTIFICATE OF CORRECTION

PATENT NO. : 7,218,169 B2
APPLICATION NO. : 10/744801
DATED : May 15, 2007
INVENTOR(S) : D. Bhattacharya et al.

It is certified that error appears in the above-identified patent and that said Letters Patent is hereby corrected as shown below:

On the Title page, Column 1, (73) Assignee

Please delete "Syatems" and insert --Systems--.

Signed and Sealed this

Sixteenth Day of October, 2007

JON W. DUDAS
*Director of the United States Patent and Trademark Office*